US010746205B2

(12) United States Patent
Steffenhagen

(10) Patent No.: US 10,746,205 B2
(45) Date of Patent: Aug. 18, 2020

(54) FLOW RESPONSIVENESS ENHANCER FOR A BLOWOUT PREVENTER

(71) Applicant: NATIONAL OILWELL VARCO, L.P., Houston, TX (US)

(72) Inventor: Timothy S. Steffenhagen, Fort Worth, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 276 days.

(21) Appl. No.: 15/748,366

(22) PCT Filed: Feb. 3, 2016

(86) PCT No.: PCT/US2016/016321
§ 371 (c)(1),
(2) Date: Jan. 29, 2018

(87) PCT Pub. No.: WO2017/023362
PCT Pub. Date: Feb. 9, 2017

(65) Prior Publication Data

US 2018/0223882 A1 Aug. 9, 2018

Related U.S. Application Data

(60) Provisional application No. 62/202,131, filed on Aug. 6, 2015.

(51) Int. Cl.
*E21B 33/06* (2006.01)
*F15B 13/08* (2006.01)
(Continued)

(52) U.S. Cl.
CPC ..... *F15B 21/045* (2013.01); *E21B 33/061* (2013.01); *E21B 33/063* (2013.01);
(Continued)

(58) Field of Classification Search
CPC ..... E21B 33/061; E21B 33/063; E21B 34/02; E21B 34/16; F15B 13/0839; F15B 21/045
See application file for complete search history.

(56) References Cited

U.S. PATENT DOCUMENTS 3,921,500 A 11/1975 Silcox
4,337,653 A 7/1982 Chauffe
(Continued)

OTHER PUBLICATIONS

International Search Report and Written Opinion dated Apr. 11, 2016 for counterpart WO Application No. PCT/US16/16321, 8 pages.

(Continued)

*Primary Examiner* — Daniel P Stephenson
(74) *Attorney, Agent, or Firm* — Jonathan Pierce; Pierre Campanac; Porter Hedges LLP

(57) ABSTRACT

A flow responsiveness enhancer apparatus may include a stack of manifolds with at least one manifold dedicated to each of the rams of the blowout preventer. The flow responsiveness enhancer includes a shared pressure line coupled to each of the manifolds, and a shared tank line coupled to each of the manifolds. Each manifold can include a 4-way directional valve that is piloted by the pressure levels in a pair of input ports. Each 4-way directional valve can couple the shared pressure line and the shared tank line to a pair of output ports.

21 Claims, 4 Drawing Sheets

(51) Int. Cl.

| | |
|---|---|
| ***F15B 21/04*** | (2019.01) |
| ***F15B 21/045*** | (2019.01) |
| ***E21B 34/02*** | (2006.01) |
| ***E21B 34/16*** | (2006.01) |

(52) U.S. Cl.
CPC ..... *E21B 34/02* (2013.01); *E21B 34/16* (2013.01); *F15B 13/0839* (2013.01)

(56) References Cited

U.S. PATENT DOCUMENTS

| | | | |
|---|---|---|---|
| 4,370,970 | A | 2/1983 | Kunz |
| 4,397,659 | A | 8/1983 | Gowan et al. |
| 4,413,642 | A | 11/1983 | Smith |
| 4,612,973 | A | 9/1986 | Whang |
| 4,618,314 | A | 10/1986 | Hailey |
| 4,626,135 | A | 12/1986 | Roche |
| 4,655,417 | A | 4/1987 | Herndon |
| 5,398,761 | A | 3/1995 | Reynolds et al. |
| 5,638,855 | A | 6/1997 | Morrill |
| 5,642,872 | A | 7/1997 | Morrill |
| 5,645,098 | A | 7/1997 | Morrill |
| 5,647,572 | A | 7/1997 | Morrill |
| 5,655,745 | A | 8/1997 | Morrill |
| 5,706,897 | A | 1/1998 | Horton |
| 5,873,416 | A | 2/1999 | Horton |
| 5,881,815 | A | 3/1999 | Horton |
| 5,992,544 | A | 11/1999 | Sprehe |
| 6,164,619 | A | 12/2000 | Van Winkle et al. |
| 6,213,215 | B1 | 4/2001 | Breivik et al. |
| 6,354,734 | B1 | 3/2002 | Curran et al. |
| 6,530,430 | B2 | 3/2003 | Reynolds |
| 6,554,072 | B1 | 4/2003 | Mournian et al. |
| 6,609,572 | B1 | 8/2003 | Anderson |
| 6,739,395 | B2 | 5/2004 | Reynolds |
| 7,163,054 | B2 | 1/2007 | Adams |
| 7,216,714 | B2 | 5/2007 | Reynolds |
| 7,216,715 | B2 | 5/2007 | Reynolds |
| 7,240,726 | B2 | 7/2007 | Cain et al. |
| 7,395,866 | B2 | 7/2008 | Milberger et al. |
| 7,497,266 | B2 | 3/2009 | Fossli |
| 7,658,228 | B2 | 2/2010 | Moksvold |
| 7,681,401 | B2 | 3/2010 | Ziminsky et al. |
| 7,682,107 | B2 | 3/2010 | Crayne et al. |
| 7,757,772 | B2 | 7/2010 | Donohue et al. |
| 7,794,577 | B2 | 9/2010 | Carson et al. |
| 7,921,919 | B2 | 4/2011 | Horton, III |
| 7,946,278 | B2 | 5/2011 | Lim |
| 8,028,755 | B2 | 10/2011 | Darnell et al. |
| 8,186,441 | B2 | 5/2012 | Donohue et al. |
| 8,322,439 | B2 | 12/2012 | Fossli |
| 8,336,128 | B2 | 12/2012 | Murphy |
| 8,418,762 | B2 | 4/2013 | Casey et al. |
| 8,464,797 | B2 | 6/2013 | Singh et al. |
| 8,485,260 | B2 | 7/2013 | Donohue et al. |
| 8,490,705 | B2 | 7/2013 | Curtiss, III |
| 8,544,536 | B2 | 10/2013 | McCulloch et al. |
| 8,607,879 | B2 | 12/2013 | Reynolds |
| 8,651,185 | B2 | 2/2014 | Hermes |
| 8,727,783 | B2 | 5/2014 | Chen |
| 8,746,346 | B2 * | 6/2014 | Voss ..... E21B 33/0355 166/344 |
| 8,820,410 | B2 | 9/2014 | Parks et al. |
| 8,839,868 | B2 | 9/2014 | Scranton et al. |
| 8,843,328 | B2 | 9/2014 | Curtiss, III |
| 8,893,803 | B1 | 11/2014 | Lugo |
| 8,960,302 | B2 | 2/2015 | Shilling et al. |
| 9,234,400 | B2 * | 1/2016 | Warnock, Jr. ..... E21B 33/0355 |
| 9,587,454 | B1 | 3/2017 | Beard et al. |
| 9,664,005 | B2 | 5/2017 | Babbitt et al. |
| 9,732,595 | B2 | 8/2017 | Wright |
| 9,879,504 | B1 | 1/2018 | Beard et al. |
| 2013/0206420 | A1 * | 8/2013 | McHugh ..... E21B 33/037 166/351 |
| 2015/0096758 | A1 | 4/2015 | Babbitt et al. |
| 2017/0139392 | A1 * | 5/2017 | Abou-Assaad ..... E21B 19/09 |
| 2018/0038187 | A1 * | 2/2018 | Bieneman ..... E21B 33/061 |
| 2018/0202252 | A1 * | 7/2018 | Pedersen ..... E21B 33/064 |
| 2018/0223882 | A1 * | 8/2018 | Steffenhagen ..... E21B 33/061 |
| 2019/0106965 | A1 * | 4/2019 | Davis ..... E21B 41/0092 |

OTHER PUBLICATIONS

International Preliminary Report on Patentability dated Feb. 15, 2018 for counterpart WO Application No. PCT/US2016/016321, 7 pages.

* cited by examiner

FLOW RESPONSIVENESS ENHANCER FOR A BLOWOUT PREVENTER

BACKGROUND

The present disclosure relates generally to techniques for performing wellsite operations. More specifically, the present disclosure relates to techniques and apparatus for preventing blowouts, particularly in cold environments.

Oilfield operations may be performed to locate and gather valuable subsurface fluids. Oil rigs are positioned at wellsites, and downhole tools, such as drilling tools, can be deployed into the ground (via, for example, wireline or coiled tubing) to reach subsurface reservoirs. Once the downhole tools form a wellbore to reach a desired reservoir, casings may be cemented into place within the wellbore, and the wellbore completed to initiate production of subsurface fluids from the reservoir. Downhole tubular devices may be positioned in the wellbore to enable the passage of subsurface fluids to the surface.

Leakage of subsurface fluids may pose an environmental threat if released from the wellbore. Equipment, such as blowout preventers (BOPs), may be positioned about the wellbore to form a seal and to prevent leakage of subsurface fluids to the surface. BOPs may have selectively actuatable rams or ram bonnets, such as pipe rams or shear rams that may be activated to seal about the downhole tools or tubular devices and/or to sever these downhole tools or tubular devices, thereby insuring complete sealing of the wellbore.

BOPs must operate in a timely manner over a wide range of ambient temperatures to function as a safety device at full performance, including at sub-freezing temperatures (i.e., below water freezing temperatures) in land based wellsites. In particular, the fluid for hydraulically actuating the rams of a BOP may become increasingly more viscous at lower temperatures; this increased viscosity may cause a reduction of rate of flow to, and from, the rams of the BOP; and the BOP may become slow and dangerously less responsive.

Solutions to BOP operation in cold temperatures have, to date, been cumbersome low technology, in the form of heaters, insulators, circulating warming fluid, portable mountable BOP systems, using specialized fluids, or heating the hydraulic fluid itself, each of which is expensive and/or impractical for real application. Thus, there is a continuing need in the art for methods and apparatus for improved time responsiveness of blowout preventers, for example when temperature conditions make the fluid used to actuate the blowout preventers very viscous.

DESCRIPTION

In one or more aspects, the present disclosure describes a flow responsiveness enhancer for improved time responsiveness of a blowout preventer. The blowout preventer may comprise a plurality of rams. To selectively open or close the rams, each ram may be associated with a corresponding manifold of a plurality of manifolds. The plurality of manifolds may optionally be assembled to form a stack of manifolds. The flow responsiveness enhancer can include at least one manifold, a shared pressure line coupled to the manifold, and a shared tank line coupled to the manifold. Further, each of the plurality of manifold may include a pressure line section coupled to pressure line sections of adjacent manifolds, and a tank line section coupled to tank line sections of adjacent manifolds. When the manifolds are assembled in the stack of manifolds, the pressure line sections form the shared pressure line running through the stack of manifolds, and the tank line sections form the shared tank line running though the stack of manifolds. As used herein, a manifold means any portion of a main conduit with one or more other conduits branching off the portion of main conduit.

The manifolds can include a pair of inputs that couple to a control cabin, one of the inputs being selected to be a pressure line and the other of the inputs being a return line. In other words, each of the plurality of manifolds forming the stack of manifolds may include a pair of input ports that couple the manifold to the control cabin via a pair of relatively small and long flowlines. One of the pair of small and long flowlines may be referred to as a control-open flowline and the other as a control-close flowline. To open the one ram associated with a particular manifold, the control-open flowline coupled to that manifold may be used as a line supplying flow to the manifold and the control-close flowline coupled that particular manifold may be used as a line returning flow from the manifold. Conversely, to close the one ram, the control-close flowline may be used as a flow supply line and the control-open flowline may be used as a flow return line. The manifolds can further include a pair of outputs that couple to the blowout preventer on the one hand, and to the shared tank line and the shared pressure line on the other hand. In other words, each of the plurality of manifolds may include a pair of output ports that couple the manifold to its associated ram via a pair of relatively large and short flowlines. One of the pair of large and short flowlines may be referred to as an actuate-open flowline and may be connected to a first output port of the pair of output ports. The other of the pair of large and short flowlines may be referred to as an actuate-close flowline and may be connected to a second output port of the pair of output ports. When flow is supplied from a particular manifold to the ram associated to that manifold via the actuate-open flowline and flow is returned to that manifold via the actuate-close flowline, the ram may open. Conversely, when flow is supplied from that manifold to the ram via the actuate-close flowline and flow is returned via the actuate-open flowline, the ram may close.

Every pair of small and long flowlines associated to a particular ram may have a high resistance to fluid flow, especially at cold temperatures when the fluid viscosity is high. Nevertheless, time responsiveness to open or close that particular ram of the blowout preventer may be improved by using the flow responsiveness enhancer, that is, it may take a shorter time to open or close that ram, because the flow responsiveness enhancer can collect into the shared pressure line hydraulic fluid from several relatively small and long flowlines associated with other rams that remain immobile, and route this fluid mostly toward the particular ram that needs to be actuated. Conversely, the fluid returning from the particular ram that needs to be actuated may be distributed from the shared tank line into several relatively small and long flowlines associated with other rams. Thus, the flow path between the control cabin and the flow responsiveness enhancer may be spread over several relatively small and long flowlines, may converge in the flow responsiveness enhancer, and be directed with valves provided in the manifolds toward the particular ram that needs to be actuated, and then reach that ram via a pair of relatively large and short flowlines.

To achieve this, the manifolds can include a first valve system that determines which of the pair of inputs has a higher pressure compared to one another. The manifolds can also include a second valve system that couples the input having a higher pressure to a first output of the pair of outputs and a second output of the pair of outputs to the shared tank line. A third valve system can couple the input having a lower pressure to the shared tank line. In other words, each of the plurality of manifolds may include a first valve system that controls flow between the pair of input ports on the one hand, and the pressure line section or possibly other manifolds along the shared pressure line on the other hand. Each of the plurality of manifolds may include a second valve system that controls flow between the pressure and tank line sections on the one hand, and the pair of output ports on the other hand. Each of the plurality of manifolds may include a third valve system that controls flow between the tank line section (and the shared pressure line) on the one hand, and the pair of input ports on the other hand. For example, the first valve system may allow fluid flow only from the one input port that has the highest pressure in the pair of input ports into the pressure line section. The second valve system may switch between at least first and second configurations. In the first configuration, the pressure line section (and the shared pressure line) may be in fluid communication with the first port of the pair of output ports, and the tank line section (and the shared tank line) may be in fluid communication with the second port of the pair of output ports. Conversely, in the second configuration, the pressure line section (and the shared pressure line) may be in fluid communication with the second output port, and the tank line section (and the shared tank line) may be in fluid communication with the first output port. The third valve system may allow fluid flow only from the tank line section, into an input port in the pair of input ports that has a pressure lower than the pressure in the tank line section.

In an embodiment, one or more of the manifolds includes one or more check valves that maintain flow in a single direction from flow responsiveness enhancer to blowout preventer, or that limit the flow from the shared pressure line to be toward the first or second output port of the pair of output ports. For example, at least one of the plurality of manifolds may include a check valve disposed between the pressure line section of that one manifold and the first or second output port of the pair of output ports. The check valve may allow fluid flow only from the pressure line section to the first or second output port of the pair of output ports, and thus to a ram of the blowout preventer.

In an embodiment, the stack of manifolds optionally includes an endcap coupled to the shared pressure line, and an endcap coupled to shared tank line.

In an embodiment, the flow responsiveness enhancer optionally includes an accumulator coupled at the endcap to the shared pressure line.

In an embodiment, the flow responsiveness enhancer optionally includes an accumulator coupled at the endcap to the shared tank line.

In an embodiment, the first valve system in at least one of the manifolds may comprise a shuttle valve.

In an embodiment, the second valve system in at least one of the manifolds may comprise a 4-way directional valve that is piloted via the pressure levels in the pair of input ports of the at least one manifold.

In further aspects, the present disclosure describes a system for improved time responsiveness of a blowout preventer. The system can include a blowout preventer with a plurality of rams. The system can also include a control valve system located in a control cabin and configured to trigger opening and closing the plurality of rams of the blowout preventer. The system can also include a shared pressure line coupling from a power pack comprising a pump driven by a motor, via the control valve system, to a flow responsiveness enhancer. The system can also include a shared tank line coupling from the power pack, via the control valve system, and to the flow responsiveness enhancer. In some embodiments however, the shared pressure line and/or the shared tank line may bypass the control valve system. The flow responsiveness enhancer comprises at least one manifold, and usually several manifolds. The manifolds may optionally be assembled to form a stack of manifolds. The shared pressure line and the shared tank line may run through each manifold of the stack of manifolds.

Each manifold can include a pair of inputs that couple to the control valve system located in the control cabin, one of the inputs being a pressure line and the other of the inputs being a return line. In other words, each of the plurality of manifolds forming the stack of manifolds may include a pair of input ports that couple the manifold to the control cabin via a pair of relatively small and long flowlines. One of the pair of small and long flowlines may be referred to as a control-open flowline and the other as a control-close flowline. Each manifold can also include a pair of outputs that couple to the blowout preventer on the one hand, and to the shared tank return line and the shared pressure line on the other hand. In other words, each of the plurality of manifolds may include a pair of output ports that couple the manifold to its associated ram via a pair or relatively large and short flowlines. One of the pair of large and short flowlines may be referred to as an actuate-open flowline and the other as an actuate-close flowline.

The flow path between the control cabin and the flow responsiveness enhancer may be spread over several relatively small and long flowlines, may converge in the flow responsiveness enhancer, and be directed with valves provided in the manifolds toward the particular ram that needs to be actuated, and then reach that ram via a pair of relatively large and short flowlines. In addition, the shared pressure line and the shared tank line may optionally provide a flow path between the power pack and the flow responsiveness enhancer, either via the control valve system located in the control cabin or bypassing the control valve system located in the control cabin. Thus, time responsiveness to open or close any particular ram of the blowout preventer may be improved by using the flow responsiveness enhancer, that is, it may take a shorter time to open or close that ram.

Each manifold can further include a first valve system that determines which of the pair of inputs has a higher pressure compared to one another, and a second valve system that couples the input having a higher pressure to a first output of the pair of outputs and a second output of the pair of outputs that couples to the shared tank line. A third valve system can couple the input having a lower pressure to the shared tank line. In other words, each of the plurality of manifolds may include a first valve system that controls flow between the pair of input ports on the one hand, and the shared pressure line on the other hand. Each of the plurality of manifold may include a second valve system that controls flow between the shared pressure and shared tank line on the one hand, and the pair of output ports on the other hand. Each of the plurality of manifolds may include a third valve system that controls flow between the shared pressure line on the one hand, and the pair of input ports on the other hand. For example, the first valve system may allow fluid flow only from the one input port that has the highest pressure in the pair of input ports into the shared pressure line. The second valve system may switch between at least first and second configurations. In the first configuration, the shared pressure line may be in fluid communication with a first one of the pair of output ports, and the shared tank line may be in fluid communication with a second one of the pair of output ports. Conversely, in the second configuration, the shared pressure line may be in fluid communication with the second output port, and the shared tank line may be in fluid communication with the first output port. The third valve system may allow fluid flow only from the shared tank line, into an input port in the pair of input ports that has a pressure lower than the pressure in the shared tank line.

In an embodiment, each ram of the blowout preventer is operatively coupled to outputs of the flow responsiveness enhancer which are in turn coupled to the shared pressure line and optionally to the power pack. In an embodiment, each ram of the blowout preventer is alternatively or additionally operatively coupled to outputs of the flow responsiveness enhancer which are in turn coupled to the shared tank line and optionally to the power pack.

In an embodiment, each manifold includes one or more check valves configured to maintain flow in a single direction from the flow responsiveness enhancer to the blowout preventer, or to limit the flow from the shared pressure line to be toward the first or second output port of the pair of output ports.

In an embodiment, when the system includes a plurality of manifolds stacked together, the system can further include an endcap on a top manifold of the plurality of manifolds and an endcap on a bottom manifold of the plurality of manifolds.

In an embodiment, the system can additionally include an accumulator coupled at a first position at the shared pressure line.

In an embodiment, the system can additionally include an accumulator coupled at a second position at the shared tank line.

In an embodiment, the first valve system in each manifold comprises a shuttle valve.

In an embodiment, the second valve system in each manifold comprises a 4-way directional valve that is piloted via the pressure levels in the pair of input ports of the manifold.

In an embodiment, the system can include a check valve in the shared pressure line between one manifold dedicated to one or more shear rams of the blowout preventer, and the other manifolds of the plurality of manifolds. In an embodiment, the system can additionally or alternatively include a check valve in the shared tank line between one manifold dedicated to the one or more shear rams of the blowout preventer, and the other manifolds of the plurality of manifolds. In such embodiments, the check valves isolate the one or more shear rams from other rams of the blowout preventer.

In still further aspects, the present disclosure describes a method for cold flow management of a blowout preventer. The method includes coupling a blowout preventer having a plurality of rams to a control valve system through a flow responsiveness enhancer. The control valve system may be located in a control cabin. The flow responsiveness enhancer can include, as described above, a plurality of manifolds with at least one manifold dedicated to each of a plurality of rams of the blowout preventer. The flow responsiveness enhancer can include a shared pressure line coupled to each of the plurality of manifolds, for example running through each of the plurality of manifolds. Similarly, the flow responsiveness enhancer can include a shared tank line coupled to each of the plurality of manifolds. Each manifold can include a pair of inputs that couple to the control valve system. Each manifold can include a pair of outputs that couple to the blowout preventer. As such, each manifold may include a pair of output ports that couple the manifold dedicated to a particular ram to that ram via a pair or relatively large and short flowlines. One of the pair of large and short flowlines may be referred to as an actuate-open flowline and the other as an actuate-close flowline. Each manifold can also include a directional valve that, in a first configuration, couples the shared pressure line to the actuate-open flowline via the first output of the pair of outputs, and couples the actuate-close flowline to the shared tank return line via the second output of the pair of outputs. The directional valve, in a second configuration, couples the shared tank line to the actuate-open flowline via the first output port and couples the shared pressure line to the actuate-close flowline via the second output port. The directional valve may be a 4-way directional valve that is piloted via the pressure levels in the pair of inputs. The method additionally includes actuating one or more rams of the blowout preventer at the control cabin using the control valve system to change the pressure in the pair of inputs.

The method can additionally include positioning an endcap on a top manifold of the plurality of manifolds and an endcap on a bottom manifold of the plurality of manifolds. In an embodiment, the method can additionally include positioning an accumulator coupled at the endcap at the shared pressure line. The shared pressure line may provide a flow path from the accumulator located near the flow responsiveness enhancer to any ram of the blowout preventer via the directional valve located in the manifold dedicated to that ram. Thus, by flowing fluid from the accumulator into that ram, time responsiveness to open or close any ram of the blowout preventer may be improved, that is, it may take a shorter time to open or close that ram. In an embodiment, the method can additionally include positioning an accumulator coupled at the endcap at the shared tank line. The shared tank line may provide a flow path from any ram of the blowout preventer to the accumulator located near the flow responsiveness enhancer via the directional valve located in the manifold dedicated to that ram. Thus, time responsiveness to open or close any particular ram of the blowout preventer may be improved by flowing fluid from that ram, through the flow responsiveness enhancer and into the accumulator, that is, it may take a shorter time to open or close that ram.

In an embodiment, the method can additionally include providing check valves in the shared pressure line and/or shared tank return line between one manifold dedicated to one or more shear rams of the blowout preventer, and the other manifolds of the plurality of manifolds, thereby isolating the one or more shear rams from other rams of the blowout preventer.

In a still further aspect, the present disclosure relates to a novel apparatus and method for control of a blowout preventer in a wide range of temperatures. Specifically, a manifold stack or set of manifolds combine the flow paths of the plurality of flowlines to a common flowline connected to the BOP. A flow responsiveness enhancer in the form of a manifold stack or set of manifolds is mounted very close to the BOP, allowing relatively high flow rate in the flowlines connected to the BOP. In further embodiments, an accumulator (or set of accumulators) may also be positioned locally to the BOP and is coupled to the flow responsiveness enhancer to increase the flow rate between the flow responsiveness enhancer and the BOP. In still another embodiment, the flowlines that have flow paths combined to the common flowline comprise control flowlines dedicated for the control of one of the rams of the BOP, and a separate flowline or a plurality of separate flowlines not dedicated for the control of one of the rams of the BOP but for the increase of flow rate to the flow responsiveness enhancer, and then to the common flowline connected to the BOP. In another embodiment, an output of some of the plurality of flowlines can be dedicated to shear rams of the BOP, due to the critical nature of the shear rams.

Embodiments of method and apparatus for flow responsiveness enhancer for a blowout preventer are now described with reference to the following figures. Like numbers are used throughout the figures to reference like features and components.

In the following description, numerous details are set forth to provide an understanding of the present disclosure. However, it will be understood by those skilled in the art that the present disclosure may be practiced without these details and that numerous variations or modifications from the described embodiments are possible.

Figure 1:
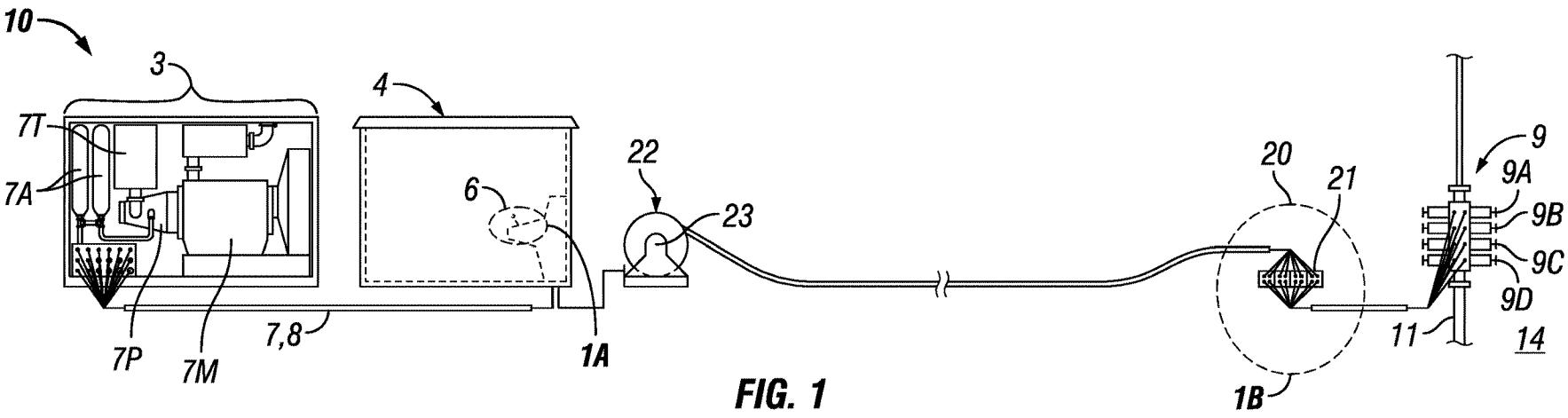
FIG. 1 is a schematic view illustrating a blowout preventer control system.
Figure 1A:
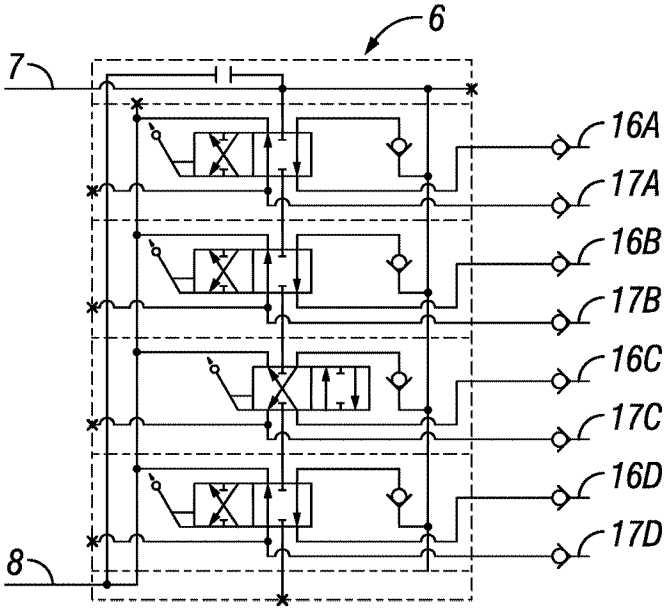
FIG. 1A is a schematic view of a portion of FIG. 1 illustrating a control valve system.

Turning now to FIGS. 1 and 1A, a blowout preventer control system 10 for use with coiled tubing unit is shown, in accordance with embodiments of the present disclosure.

The coiled tubing unit may be a known, frequently used apparatus that can be stationed at a well site 14 during the phase in which a BOP 9 is installed over a wellbore 11. The coiled tubing unit may include a reel of coiled tubing used to shuttle equipment up and down the wellbore 11, and to inject process fluids as the reel winds and unwinds the tubing. Operation of a coiled tubing unit often includes use of a hydraulic fluid in hydraulically manipulated components. Examples of hydraulically manipulated components often found in a coiled tubing unit include a coiled tubing reel, a coiled tubing injector, and a BOP system (e.g., the BOP 9) and multiple pumps.

In a coiled tubing BOP, the number of rams can vary from one ram to eight rams (only four are illustrated in FIG. 1). A hydraulic power pack 3 including a hydraulic tank 7T, a hydraulic pump 7P coupled to an engine 7M, and hydraulic power storage accumulators (e.g., in the accumulator system 7A), can supply pressure and flow to the BOP 9 via a control valve system 6 that has multiple banked directional control valves and that is located in the control cabin 4. For example, a common configuration may include an 8 to 10 banked directional control valves (only four are illustrated in FIG. 1), where each control is assigned to a BOP ram 9*a*, 9*b*, 9*c* and 9*d*, and directs an inlet supply 7 and a hydraulic return 8 to each ram individually in the form of a pair of control flowlines 16*a-d* and 17*a-d*, one of which supplies pressured hydraulic fluid and the other of which returns the hydraulic fluid. The controls of the control valve system 6 are engaged to open or close each ram in operation by switching which flowline of the pair is at a high pressure and supplies the hydraulic fluid and which flowline of the pair is at low pressure and returns the hydraulic fluid.

The blowout preventer control system 10 may utilize small flowlines 16*a-d* and 17*a-d* that are routed through an optional hydraulic swivel 23 of a reel 22 to manage long flowlines (typically hundreds of feet, and in a particular practical embodiment, 150 to 200 feet) to enable placement of the control cabin 4 at a safe distance from the wellbore 11. Each ram 9*a*, 9*b*, 9*c* or 9*d* having two control flowlines, respectively 16*a* and 17*a*, 16*b* and 17*d*, 16*c* and 17, or 16*d* and 17*d*, necessarily results in two to sixteen flowlines (only 8 are illustrated in FIG. 1) being connected to the flow responsiveness enhancer 20. In a typical embodiment, each flowline is approximately ⅜ inch in diameter.

The hydraulic power pack 3 operates on hydraulic fluid to power the coiled tubing operation. The hydraulic fluid usually becomes increasingly viscous with lower temperatures. The temperature in flowlines that do not continuously flow, such as the BOP control lines, can be below water freezing temperatures in certain environments. Viscous fluid in long, small diameter flowlines can result in dangerously slow BOP actuation.

Figure 1B:
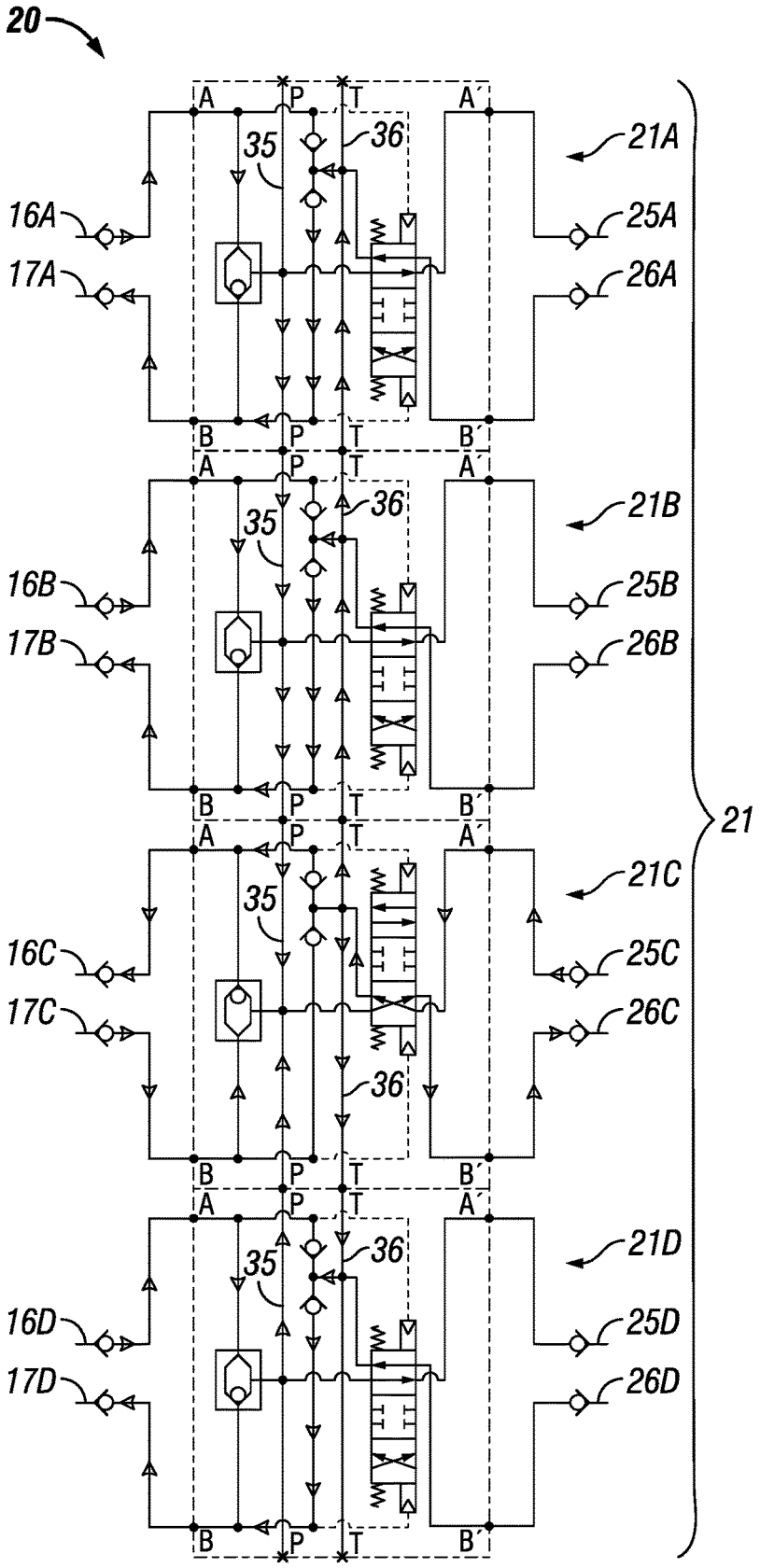
FIG. 1B is a schematic view of a portion of FIG. 1 illustrating a flow responsiveness enhancer.

In the configuration shown in FIGS. 1 and 1B, a flow responsiveness enhancer device 20 may include a set of manifolds 21*a*, 21*b*, 21*c* and 21*d* (or stack of manifolds 21) positioned near to the BOP 9, sharing the flow path of all the control flowlines to the flow responsiveness enhancer 20, optionally without additional flowlines. With the flow responsiveness enhancer 20 positioned very near to the BOP 9, very short, high flow rate lines may be used to connect from the flow responsiveness enhancer 20 to the BOP 9, ensuring fast response times for the rams of the BOP 9.

The valve system 6 includes multiple banked directional valves, and allows multiple flow paths to communicate pressure signals and to supply hydraulic fluid to the flow responsiveness enhancer 20. The flow responsiveness enhancer 20 comprises elements that are reactive to differential pressure signals. Thus, relative pressure levels in the pair of control flowlines 16*a* and 17*a* select the open or close state of ram 9*a*. However, supply or return of hydraulic fluid in the control flowlines 16*a* and 17*a* without change of relative pressure may not always imply movement of the ram 9*a*, because this supply or return of hydraulic fluid may also be used by the flow responsiveness enhancer 20 to move the other rams 9*b*, 9*c*, or 9*d*. The behavior of the flow responsiveness enhancer 20 in response to pressure changes and fluid flow in the pairs of control flowlines 16*b* and 17*b*, 16*c* and 17*c*, or 16*d* and 17*d* may be similar to behavior of the flow responsiveness enhancer 20 in response to pressure changes and fluid flow in the pair of control flowlines 16*a* and 17*a*. As such, the flow responsiveness enhancer 20 may separate flow and pressure signals so that the flow and pressure signals work differently on ram actuation. Further, the flow responsiveness enhancer 20 permit the flows through the pairs of control flow lines, 16*a* and 17*a*, 16*b* and 17*b*, 16*c* and 17*c* to work together on the actuation of any of the rams 9*a*, 9*b*, 9*c* and 9*d*.

Typically, at least one manifold per BOP ram is used in a stack in the flow responsiveness enhancer device 20. Accordingly, a flow responsiveness enhancer 20 may include between two and eight manifolds as described with respect to FIG. 2, and more preferably, may include eight manifolds. The function of flow responsiveness enhancer 20 is exhibited by further examination of each manifold thereof, with reference to FIGS. 1B and 2. While the manifolds 21*a*, 21*b*, 21*c* or 21*d* are described herein as a discrete physical device, it is also envisioned that a plurality of circuits accomplishing the same ends may be employed within a single discrete device or a stack of several discrete devices.

Each manifold 21*a*, 21*b*, 21*c* or 21*d* may be coupled to an associated BOP ram 9*a*. 9*b*, 9*c* or 9*d* by a pair of relatively larger diameter, short length flowlines or hoses 25*a* and 26*a*, 25*b* and 26*b*, 25*c* and 26*c*, 25*d* and 26*d*. Because the BOP 9 may have between one and eight rams, there may be between two and sixteen flowlines between the flow responsiveness enhancer 20 and the BOP 9 (only eight are shown in FIG. 1). In a typical embodiment, each flowline may be approximately ¾ inch in diameter.

Figure 2:
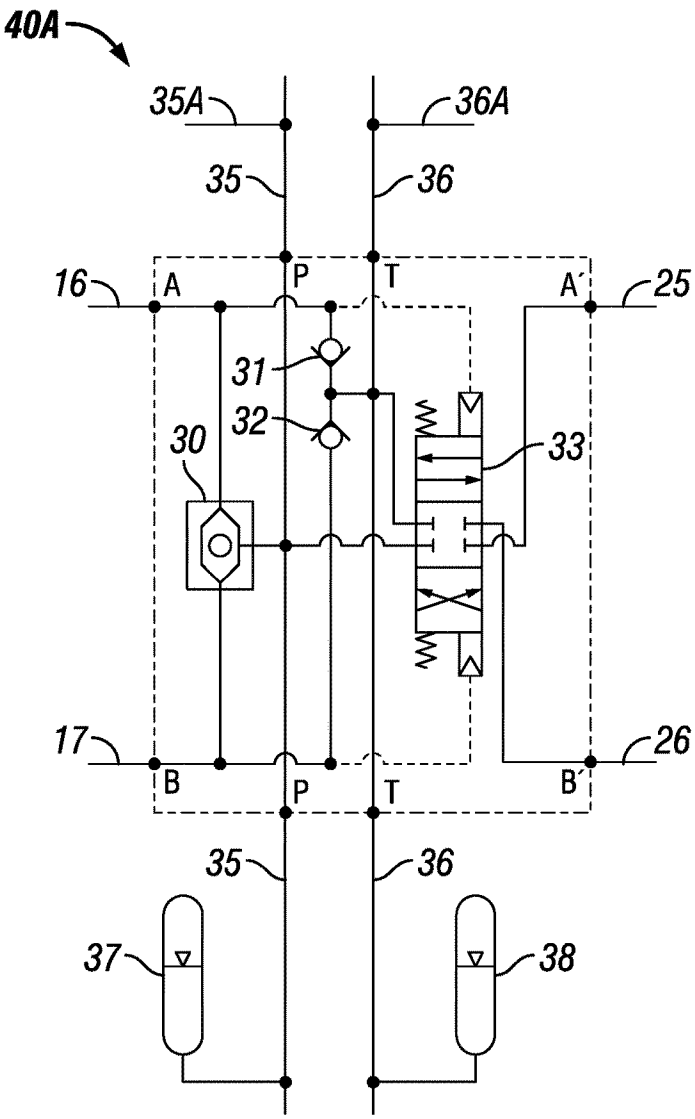
FIG. 2 is a schematic view illustrating an embodiment of a manifold shown in FIG. 1B.

FIG. 2 shows a schematic for a single manifold 40*a* of the flow responsiveness enhancer of the present disclosure. Label 35 represents a shared pressure line and label 36 represents a shared tank line. The shared pressure line 35 may run through several manifolds identical to manifold 40*a*, and may be formed from several pressure line segments, one segment in each manifold of the stack of manifolds. Similarly, the shared tank line 36 may run through several manifolds identical to manifold 40*a*, and may be formed from several tank line segments, one segment in each manifold of the stack of manifolds.

For purposes of explanation, consider ports A and A' as on the "engage" or "close" side of the hydraulic circuit to actuate one of the BOP rams 9*a*, 9*b*, 9*c* or 9*d*, and ports B and B' as on the "disengage" or "open" side of the hydraulic circuit to actuate the same BOP ram. Ports A and B of the manifold 40*a* couple via relatively smaller diameter, longer length flowlines or hoses to the control valve system 6, for example via pair of control flowlines 16 and 17. Thus the flowline 16 may be the control flowline referred to as control-close, and the flowline 17 may be referred to as control-open. Ports A' and B' couple via relatively larger diameter, short length flowlines or hoses to one BOP ram, via pair of flowlines 25 and 26. Thus the flowline 25 may be referred to as actuate-close and the flowline 26 may be referred to as actuate-open.

Ports P and T carry fluid in shared pressure and tank flowlines 35 and 36 within a stack of manifolds 21, and couple to adjacent manifolds for supply and return of fluid to or from others of the BOP rams. A shuttle value 30 compares the pressure between port A and port B, passing fluid from the port having the higher pressure of the two ports to the shared pressure line 35. Check valves 31 and 32 restrict flow to a single direction, passing fluid from the shared tank line 36 to any of the two ports that has a lower pressure, out of the manifold stack 21 and toward the control valve system 6 and the tank 7T. When the pressure on port A is greater than the pressure on port B, directional valve 33 shifts down, such that the shared tank line 36 connects to port B' and the shared pressure line 35 connects to port A'. Alternatively, when the pressure on port B is greater than the pressure on port A, directional valve 33 shifts up, such that the shared tank line 36 connects to A' and the shared pressure line 35 connects to port B'.

When a plurality of manifolds such as the one shown in FIG. 2 are combined in a stack 21 shown in FIG. 1B, the fluid in the shared pressure line may flow to any of the manifolds in the stack of manifolds 21, as well as the fluid in the tank line may flow to any of the manifolds in the stack of manifolds 21.

In an embodiment, the shared pressure line 35 and the shared tank line 36 may be sealed or capped at each end of a stack of manifolds 21. Alternatively, the shared pressure line 35 may be extended by a common pressure flowline 35*a* to the control valve system 6 (shown in FIG. 1) and to the power pack 3 (shown in FIG. 1) or directly to the power pack 3. Similarly the shared tank line 36 may be extended by a common return flowline 36*a* to the control valve system 6 and to the power pack 3 or directly to the power pack 3. Furthermore, the common pressure flowline 35*a* and or the common return flowline 36*a* may be provided as separate high rate flowlines connected to the swivel 23 and running along the long pairs of control flowlines or hoses 16*a-d* and 17*a-d*.

In a further embodiment, a high flow rate supply of fluid can be added to some or all of the manifolds (or to the stack of manifolds 21) by adding one or more high pressure accumulators 37 (e.g., over 1000 psi gas charge) at or near the position of the flow responsiveness enhancer 20, and coupling the accumulators 37 to shared pressure line 35.

In a further embodiment, a high flow rate return of fluid can be added to some or all of the manifolds (or to the stack of manifolds 21) to reduce back pressure, by adding one or more low pressure accumulators 38 (e.g., under 300 psi gas charge) at or near the position of the stack of manifolds 21, and coupling the accumulators 38 to shared tank line 36.

In some BOPs, one or more rams of the plurality of rams are shear rams which can require dedicated accumulators and pressure/control lines. Due to the critical nature of a shear ram, in an embodiment of the present disclosure illustrated in FIG. 3, check valves 41 and 42 may be added in the shared pressure and tank lines 35 and 36 between the manifolds dedicated to shear rams (only one dedicated manifold 21*e* is shown) and the other manifolds in the stack (only one other manifold 21*f* is shown). The check valves 41 and 42 serve to isolate the shear rams from the other rams, and ensure that the fluid that is supplied to the manifolds dedicated to the shear rams is conveyed to the shear rams even to the detriment of fluid responsiveness of other rams.

In an alternative embodiment, a stack of manifolds 21 may be replaced instead by separate manifolds each coupled to separable BOPs, with the improved responsiveness being maintained by joining the pressure line sections and tank line section of each manifold by flowlines or hoses to form the shared pressure and tank lines.

Figure 3:
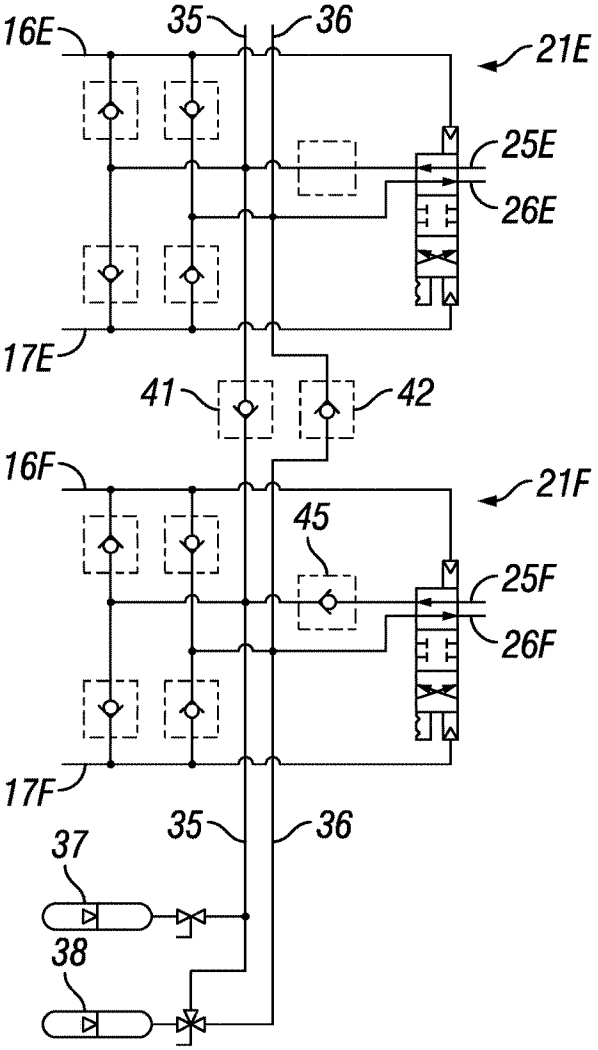
FIG. 3 is a schematic view illustrating a flow responsiveness enhancer comprising a stack of manifolds having check valves added between a manifold dedicated to a shear ram another manifold. While one manifold is shown dedicated to one shear ram in FIG. 3, two or more manifolds may be dedicated to two or more shear rams.
Figure 4:
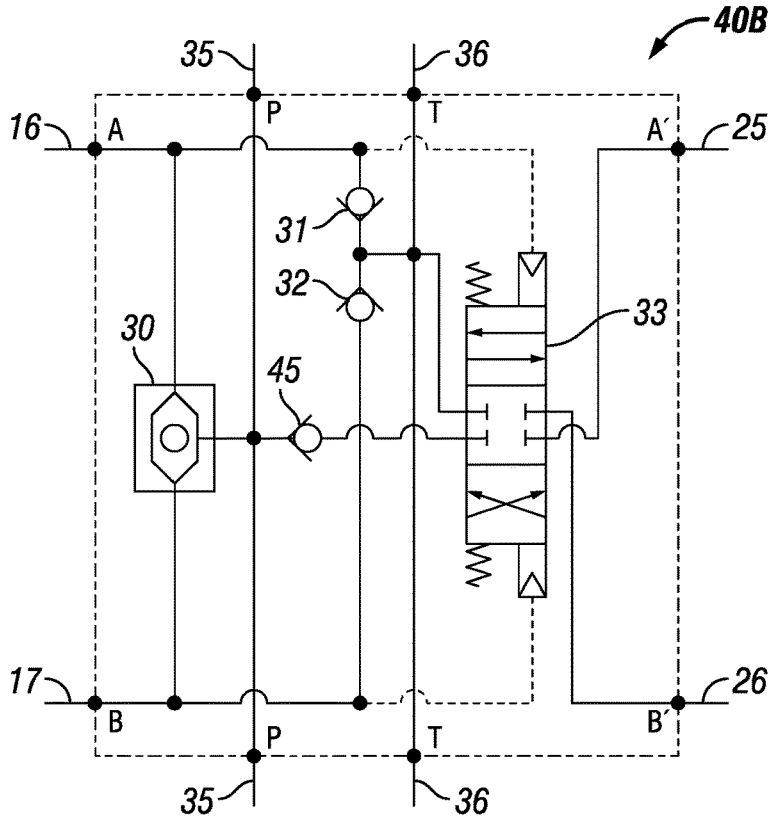
FIG. 4 is a schematic view illustrating an embodiment of a manifold for a flow responsiveness enhancer, the manifold having one or more check valves configured to maintain flow in a single direction from flow responsiveness enhancer to blowout preventer, or to limit the flow from the shared pressure line to be toward the first or second output port of the pair of output ports.

Referring to FIGS. 3 and 4, at least one of the manifolds (21*f*, 40*b*) may include one or more check valves 45 that maintain flow in a single direction from flow responsiveness enhancer 20 to BOP 9, or that limit flow from the shared pressure line 35 to be toward the first or second output port A' or B' of the pair of output ports. For example, check valve 45 may be dispose between the shared pressure line 35 of one manifold and the first or second output port A' or B'. The check valve may allow fluid flow only from the shared pressure line 35 to the first or second output port A' or B', and thus to a ram 9*a*, 9*b*, 9*c* or 9*d* of the BOP 9.

Figure 5:
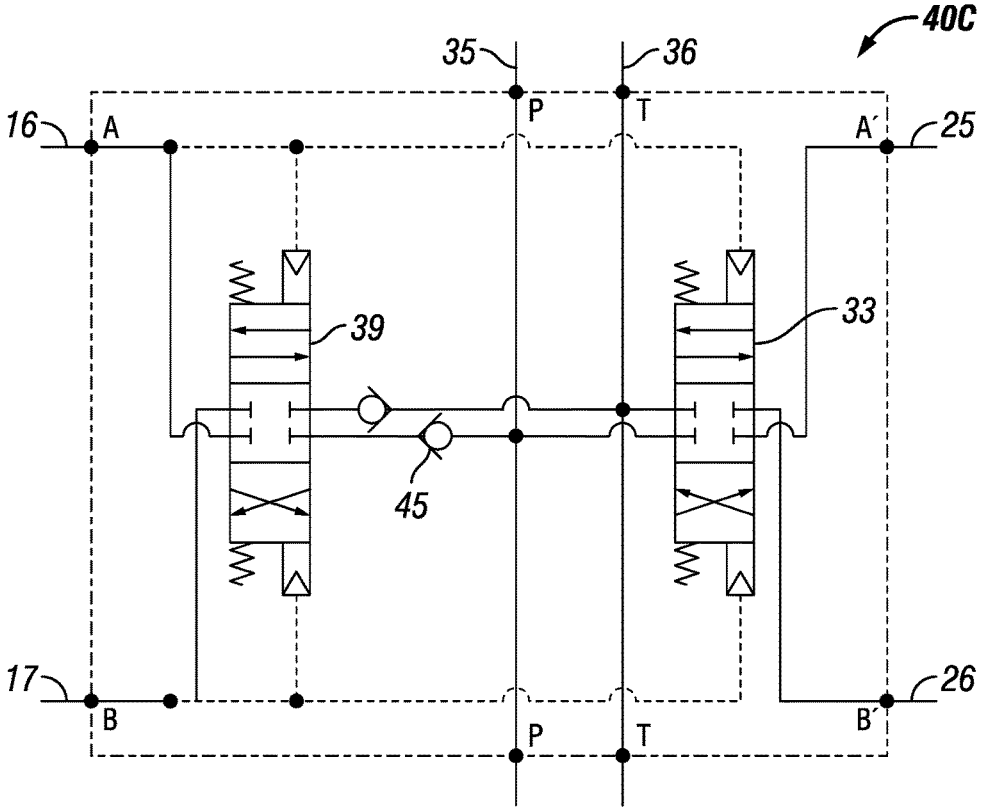
FIG. 5 is a schematic view illustrating an embodiment of a manifold for a flow responsiveness enhancer, the manifold including two 4-way directional valves that are piloted by the pressure levels in one pair of control flowlines.

Turning to FIG. 5, an embodiment of a manifold 40*c* having two 4-way directional valves that are piloted by the pressure levels in one pair of control flowlines is illustrated. The first 4-way directional valve 33 is similar to the 4-way directional valve 33 shown in FIG. 2 or 4 for example. The function of the first 4-way directional valve 33 is to control flow between the shared pressure and tank lines (respectively 35 and 36) on the one hand, and the pair of output ports A' and B' on the other hand. The second 4-way directional valve 39 combines the functions of shuttle valve 30 and the check valves 31 and 32 shown in FIG. 2 or 4. Thus, the second 4-way directional valve 39 controls flow from one port A or B of the pair of input ports into the shared pressure line, as well as flow from the shared tank line into the other port of the pair of input ports respectively B or A. For example, if the pressure in the control flowline 16 is higher than the pressure in the control flowline 17, the second 4-way directional valve 39 shifts down, allowing flow from port A into the shared pressure line 35, and flow from the shared tank line 36 into port B. The flow is crossed when pressure in the control flowline 17 is higher than the pressure in the control flowline 16.

While the disclosure has been disclosed with respect to a limited number of embodiments, those skilled in the art, having the benefit of this disclosure, will appreciate numerous modifications and variations therefrom. While the disclosure has been described in the context of applications in improving responsiveness of flow to a BOP, the apparatus of the disclosure can be used in many applications. Likewise, while particular configurations involving check valves, shuttle valves, and/or directional valves are expressly noted, all logical equivalents to such devices are contemplated as within the design considerations of one of ordinary skill in the art.

Although a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not simply structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The preferred aspects and embodiments were chosen and described in order to best explain the principles of the invention and its practical application. The preceding description is intended to enable others skilled in the art to best utilize the invention in various aspects and embodiments and with various modifications as are suited to the particular use contemplated. In addition, the methods may be programmed and saved as a set of instructions, that, when executed, perform the methods described herein. It is intended that the scope of the invention be defined by the following claims.

What is claimed is:

1. A flow responsiveness enhancer for improved time responsiveness of a blowout preventer, comprising:

a first section;

a shared pressure line coupled to the first section;

a second section coupled to the shared pressure line;

wherein the first section includes:

a pair of input ports;

a pair of output ports;

a first valve system that controls flow from one port of the pair of input ports into the shared pressure line; and a second valve system that controls flow from the shared pressure line into one port of the pair of output ports, and wherein the second section includes:

another pair of input ports;

another pair of output ports;

a third valve system that controls flow from one port of the other pair of input ports into the shared pressure line; and a fourth valve system that controls flow from the shared pressure line into one port of the other pair of output ports.

2. The flow responsiveness enhancer of claim 1, further comprising a shared tank line coupled to the first section and the second section, and wherein the first section further includes a fifth valve system that controls flow from the shared tank line into another port of the pair of input ports of the first section.

3. The flow responsiveness enhancer of claim 2 wherein the fifth valve system comprises check valves.

4. The flow responsiveness enhancer of claim 1 further comprising a shared tank line coupled to the first and second sections, and wherein the second valve system further controls flow from another port of the pair of output ports of the first section into the shared tank line.

5. The flow responsiveness enhancer of claim 1 wherein the second valve system comprises a 4-way directional valve that is piloted by the pressure levels in the pair of input ports of the first section.

6. The flow responsiveness enhancer of claim 1 wherein the first valve system comprises a shuttle valve.

7. The flow responsiveness enhancer of claim 1 further comprising a check valve to limit flow from the shared pressure line to be toward the one port of the pair of output ports of the first section.

8. The flow responsiveness enhancer of claim 1 further comprising an accumulator coupled to the shared pressure line.

9. The flow responsiveness enhancer of claim 1 wherein the shared pressure line is coupled to a power pack to supply fluid to the first and second sections.

10. The flow responsiveness enhancer of claim 1 further comprising a check valve disposed along the shared pressure line between the first and second sections.

11. The flow responsiveness enhancer of claim 1 wherein each of the first and second sections is a manifold.

12. A system for improved time responsiveness of a blowout preventer, comprising:

a power pack to supply pressurized fluid;

a control valve system;

a blowout preventer having one or more rams;

a flow responsiveness enhancer having one or more sections, each section being operatively associated with one ram and fluidly coupled thereto;

one or more pairs of control flowlines, each pair of control flowlines being operatively associated with one section of the flow responsiveness enhancer;

wherein the control valve system includes a plurality of banked directional valves to selectively flow and return fluid between each section of the flow responsiveness enhancer and the power pack through one pair of control flowlines;

wherein the flow responsiveness enhancer comprises a shared pressure line running through each section, and a shared tank line running through each section; and wherein each section of the flow responsiveness enhancer includes a first valve system that controls flow from one pair of control flowlines into the shared pressure line, a second valve system that controls flow from the shared pressure line to one ram and from the one ram into the shared tank line, and a third valve system that controls flow from the shared tank line into the one pair of control flowlines.

13. The system of claim 12 wherein the first valve system comprises a shuttle valve.

14. The system of claim 12 wherein the second valve system comprises a 4-way directional valve that is piloted by the pressure levels in one pair of control flowlines.

15. The system of claim 12 further comprising one or more check valves to limit flow from the shared pressure line to be toward the blowout preventer.

16. The system of claim 12 wherein the flow responsiveness enhancer has at least two sections, the system further comprising a check valve coupled on the shared pressure line, the check valve being disposed between the at least two sections.

17. The system of claim 12 wherein the flow responsiveness enhancer has at least two sections, the system further comprising a check valve coupled on the shared tank line, the check valve being disposed between the at least two sections.

18. The system of claim 12 further comprising an accumulator coupled to the shared pressure line.

19. The system of claim 12 further comprising an accumulator coupled to the shared tank line.

20. The system of claim 12 further comprising a common pressure flowline coupled to the shared pressure line and to the power pack for supplying pressurized fluid to the one or more sections, and a common return flowline coupled to the shared tank line and to the power pack for returning fluid to the power pack.

21. The system of claim 12 wherein the one or more sections are manifolds forming a stack of one or more manifolds.

* * * * *